US012178377B2

(12) United States Patent
Schaumann et al.

(10) Patent No.: US 12,178,377 B2
(45) Date of Patent: Dec. 31, 2024

(54) DISHWASHER, METHOD FOR CONTROLLING A DISHWASHER, COMPUTER PROGRAM AND DATA CARRIER

(71) Applicant: E.G.O. Elektro-Geraetebau GmbH, Oberderdingen (DE)

(72) Inventors: Uwe Schaumann, Oberderdingen (DE); Wolfgang Thimm, Karlsruhe (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 356 days.

(21) Appl. No.: 17/812,229

(22) Filed: Jul. 13, 2022

(65) Prior Publication Data

US 2023/0013323 A1 Jan. 19, 2023

(30) Foreign Application Priority Data

Jul. 15, 2021 (DE) ..... 10 2021 207 534.7

(51) Int. Cl.
*A47L 15/00* (2006.01)
*A47L 15/42* (2006.01)
*A47L 15/44* (2006.01)

(52) U.S. Cl.
CPC ..... *A47L 15/006* (2013.01); *A47L 15/449* (2013.01); *A47L 15/0063* (2013.01); *A47L 15/4274* (2013.01)

(58) Field of Classification Search
None
See application file for complete search history.

(56) References Cited

U.S. PATENT DOCUMENTS

2011/0204096 A1* 8/2011 Kessler ..... A47L 15/4463 222/129
2012/0125366 A1 5/2012 Beshears, Jr. et al.
(Continued)

FOREIGN PATENT DOCUMENTS

DE 102016225833 A1 6/2018
DE 102017201109 A1 7/2018
(Continued)

OTHER PUBLICATIONS

European Patent Office, Extended European Search Report received for Application No. 22183553.1, dated Dec. 19, 2022, 10 pages, Germany.
(Continued)

*Primary Examiner* — Rita P Adhlakha
(74) *Attorney, Agent, or Firm* — ALSTON & BIRD LLP

(57) ABSTRACT

A dishwasher has a tub with tub walls and with an outlet, water pipes, valves, a pump, a water inlet into the tub, a dosing module in the tub that has supply compartments for additives and cleaning agents for a cleaning process, wherein the dosing module is designed as a self-contained structural unit independent of the dishwasher and removable therefrom. A control unit is provided for the dishwasher, for the dosing module, for the pump and for the valves. The dosing module has a communication module for communication with the control unit, wherein a planar transmission device having a plurality of L-C-resonant circuits inductively coupled to one another and each with a transmitting coil and a transmitting capacitor is arranged along a tub wall of the tub for transmitting signals and power. The transmission device connects the control unit and the dosing module to one another to permit signal transmission.

23 Claims, 4 Drawing Sheets

(56) References Cited

U.S. PATENT DOCUMENTS

| | | | |
|---|---|---|---|
| 2020/0113405 | A1 | 4/2020 | Kessler et al. |
| 2021/0348088 | A1 | 11/2021 | Kessler et al. |

FOREIGN PATENT DOCUMENTS

| | | | |
|---|---|---|---|
| EP | 3059480 | A1 | 8/2016 |
| IT | 201800003574 | A1 | 9/2019 |
| WO | WO 2009/146692 | A2 | 12/2009 |
| WO | WO 2018/196941 | A1 | 11/2018 |
| WO | WO 2020/152004 | A1 | 7/2020 |

OTHER PUBLICATIONS

German Patent and Trade Mark Office, Office Action received for Application No. DE 102021207534.7, mailed May 9, 2022, 9 pages, Germany.

* cited by examiner

DISHWASHER, METHOD FOR CONTROLLING A DISHWASHER, COMPUTER PROGRAM AND DATA CARRIER

CROSS-REFERENCE TO RELATED APPLICATIONS

This application claims priority to German Application No. 10 2021 207 534.7, filed Jul. 15, 2021, the contents of which are hereby incorporated herein in its entirety by reference.

AREA OF APPLICATION AND PRIOR ART

The invention relates to a dishwasher and to a method for controlling such a dishwasher, to a computer program designed for performing the method at a control unit of the dishwasher, and to a data carrier on which such a computer program is stored.

A cleaning system that can be inserted as a self-contained module into a dishwasher as a kind of dosing module is known from WO 2020/152004 A1. Furthermore, it is designed self-sufficient and contains both several different additives and/or cleaning agents for a cleaning process inside the dishwasher, and also a self-contained control unit with dosing of the aforementioned agents. It is also provided with its own power supply. However, the control unit and the power supply make this dosing module expensive.

A hob with a hob plate and induction heating coils arranged thereunder is known from DE 10 2017 201 109 A1. In addition, a transmission device extending over a larger surface is provided that consists of resonant circuits inductively coupled to one another. Each of these resonant circuits has a transmission coil and a transmission capacitor that form an L-C resonant circuit. This transmission device is designed very flat and/or thin and can be used for controlling additional operating elements or lighting from elsewhere. This allows in particular a saving on the expense of providing additional cabling or a supply line in the region of several induction heating coils possibly placed close together.

OBJECT AND SOLUTION

The object underlying the invention is to create a dishwasher previously mentioned, a method previously mentioned, a computer program previously mentioned and a data carrier designed for it, using which problems of the prior art can be solved and using which it is in particular possible to operate easily and practically a dishwasher with an aforementioned dosing module therein.

This object is solved by a dishwasher having the features of claim 1, by a method having the features of claim 21, by a computer program having the features of claim 22 and by a data carrier having the features of claim 23. Advantageous and preferred embodiments of the invention are the subject matter of further claims and are explained in more detail in the following. Some of the features are described only for the dishwasher, only for the method, only for the computer program or only for the data carrier. Regardless of this, they are however intended to apply by themselves and independently of one another for a dishwasher, for a method for its control, for a computer program and for a data carrier. The wording of the claims is based on express reference to the content of the description.

The dishwasher in accordance with the invention has a tub with tub walls, with an outlet and with water pipes, valves and a pump. These are usually so provided in dishwashers. At least one water inlet into the tub is provided and is connected to the pump by means of water pipes. The same may apply for an outlet from the tub. This is as a rule routed to the pump with filters. Furthermore, a dosing module for the dishwasher is provided, which is placed into the tub or is used in the tub. The dosing module contains additives and/or cleaning agents known from the prior art previously mentioned. These agents are introduced or added to a cleaning process inside the dishwasher, of course matching the progress of the respective process. The dosing module has at least one supply compartment for an additive and/or a cleaning agent, and advantageously several supply compartments for several agents. It has furthermore at least one dosing valve for releasing or dosing an appropriate agent into the tub. The dosing module is designed here as a self-contained structural unit that can be removed from the dishwasher or tub and is independent thereof. In particular, removal is possible without tools and with little effort. Finally, the dishwasher also has a control unit that can also be used for the dosing module, for the pump and for the valves. Particularly advantageously, only a single control unit is provided in the entire dishwasher that per se also passes on the commands to the dosing module, which are then implemented therein by the aforementioned dosing valves. In addition, a dosing module may also have sensors that can also be controlled and/or evaluated by the control unit. The dosing module therefore does not have to have a control unit for sensors of this type.

In accordance with the invention, the dosing module has a communication module for communicating with the control unit. Advantageously, this is a bidirectional communication. Furthermore, the dishwasher has a transmission device which is designed to work together with the communication module of the dosing module, or the two are coordinated with one another. The transmission device is designed planar, preferably with a size of at least 5 cm×10 cm, in particular at least 20 cm×50 cm. It is arranged along a wall of the tub, in particular on the outside or underside of the tub or outside the tub. This transmission device is designed to transmit signals and/or power in the surface of the transmission device. It is in particular possible, using the dosing module and possibly also with further functional units in the tub or on the dishwasher, for signals to be exchanged or for communication to take place. Furthermore, it should also be possible to transmit power if required, so that the dosing module as described above, and if required other functional units too, does not need to have its own power supply. Its design and its arrangement can be freer and more advantageous as a result.

The transmission device has a plurality of resonant circuits inductively coupled to one another. Each resonant circuit has a transmitting coil and a transmitting capacitor and is hence designed as an L-C-resonant circuit. The transmitting coil, an inductance and the transmitting capacitor or a capacitor are advantageously designed separate from one another, but can if required also be accommodated in a single component. The transmitting coils extend here substantially in that surface in which the entire transmission device also extends. This surface is advantageously parallel to the wall of the tub in that region in which the dosing module is advantageously arranged. The resonant circuits or the transmitting coils also have relatively short distances from one another, advantageously between 1% and 10% of the diameter of a transmitting coil or between 1 mm and 20 mm. The transmission device extends here up to a place at which the dosing module or the communication module is arranged or can advantageously be arranged. Its signal-transmitting connection is thus as easy to achieve as possible. Furthermore, the transmission device is connected to the control unit to permit signal transmission at least during operation of the dishwasher, in particular directly connected. An electronic power unit and/or an inverter are also advantageously provided in the dishwasher, which can also be connected to the transmission device. This is explained in more detail in the following.

In a preferred embodiment of the invention, a signal-transmitting connection between the communication module of the dosing module and the transmission device is designed wireless, particularly preferably inductive over said distance of several centimeters. This allows a good and secure signal-transmitting connection through the tub wall to the dosing module. For that purpose the communication module has particularly advantageously a coil that can be inductively coupled to the transmission device. Inductively couplable coils of this type for communication modules in particular are known to the person skilled in the art.

In an embodiment of the invention, the dosing module can be designed without its own power supply, so that it is in fact supplied with power only by means of the transmission device, preferably wirelessly. This is a very simple embodiment. In a possible further embodiment of the invention, it can be provided that a dosing module is nevertheless provided with its own power source. This has the advantage that certain functions and/or memory content or the like can be retained even when the dosing module is removed from the tub. This can also apply for displays or the like. A power supply or internal power source for the dosing module can be a primary or secondary battery, possibly also a capacitor in a simple embodiment. The charging of an appropriate rechargeable power source can be performed by means of the transmission device.

In a generally possible embodiment of the invention, the control unit can be directly or galvanically connected to the transmission device to permit signal transmission, for example via sealed electric contacts and/or a sealed cable through the wall of the tub. Advantageously, however, a wireless and inductive signal-transmitting connection is provided which in particular enables the tub wall to be designed without penetrations and to prevent insulation problems during signal transmission and power transmission. To do so, the control unit can be connected to a control coil which is in turn inductively coupled to the transmission device. This could then be provided, corresponding to the signal-transmitting connection, between the dosing module and the transmission device.

In an advantageous further embodiment of the invention, the control unit is connected to an inverter or in general to an electronic power unit of the dishwasher. This inverter too is connected to the control coil, in particular connected to permit signal transmission and power transmission. To do so, the inverter can, in a control mode, control the control coil and in particular the transmission device, in order to transmit signals and also, if required, power per se to the communication module and/or to the dosing module by means of the transmission device. The general power supply of the dosing module previously mentioned is thus advantageously achieved via said inverter, regardless of whether the latter is directly or galvanically or inductively coupled to the transmission device.

Furthermore, the inverter or the electronic power unit can be designed to supply the pump of the dishwasher with power and to drive it in a further mode, i.e. in a pump mode. To do so, the control unit can generate appropriate control signals for the best possible operation of the pump. Furthermore, the dishwasher can also have a heater, which is advantageously integrated into the pump. This heater can also be controlled and operated by the inverter or an electronic power unit if required.

The stated control unit of the dishwasher is designed to control valves present in the dishwasher. Sensors present in the dishwasher can also be controlled with it.

Advantageously, the control unit is the only control unit in the entire dishwasher, and can have a microcontroller which is then the only microcontroller in the entire dishwasher. The dosing module too can then be designed without its own microcontroller. This simplifies its design.

In a further advantageous embodiment of the invention, it can be provided that a signal-transmitting connection not only to the dosing module by means of the transmission device, but also to outside the dishwasher, in particular to a mobile terminal, is possible. Such a mobile terminal, which can advantageously be a tablet computer or a smartphone, can thus be connected to permit signal transmission and if required also power transmission to the dishwasher or be connected thereto. This enables operation of the dishwasher by means of this mobile terminal, which would otherwise be more difficult. The transmission device can thus also be provided along an outside of the dishwasher, but on its inner face, i.e. not on the outside itself. A door of the dishwasher, for example, can be used here, on which door a mobile terminal can be arranged or fastened and then connected to permit signal transmission to the control unit and/or to the dosing module. This is advantageously achieved by an inductive coupling or by an NFC method, nowadays provided in many mobile terminals.

In an advantageous further embodiment of the invention, the transmission device can extend not only as a kind of wide strip from a place of connection to the control unit and/or from the electronic power unit or inverter to an intended place for the dosing module; the transmission device can also take up a larger surface, in particular on the bottom of the tub as a tub wall. The transmission device can thus take up at least one third of this floor surface, and preferably at least two thirds. This also makes it easy to place the dosing module at another point at the bottom of the tub, for example for varying technical reasons. Further sensors or functional units may also be arranged at the bottom of the tub and then connected in simple manner to the control unit and/or to an electronic power unit or to an inverter for power supply.

In an advantageous development of the invention, the transmission device and the control unit are designed to detect a place at which the dosing module is arranged in the tub. The dosing module should of course in turn be arranged at the necessary short distance to the transmission device for that purpose. This can for example be used to control a water inlet having an adjustable nozzle or the like such that water is conveyed at least for a limited time where possible to the place at which the dosing module is arranged. The agent released thereby can be dissolved as well as possible and hence be used. The control unit can therefore for example direct an adjustable nozzle onto the dosing module, having determined its place of attachment inside the tub by means of the transmission device.

The method in accordance with the invention, with which the control unit can control the dosing module via the transmission device, can be achieved by an appropriate computer program. The latter can be input into the control unit or into a memory of the control unit. This computer program is advantageously stored on a data carrier, which can for example be a memory chip, alternatively also a diskette, DVD or the like.

These and further features are found in the description and in the drawings as well as in the claims, wherein the individual features can each be realized singly or severally in the form of sub-combinations in one embodiment of the invention and in other fields, and can represent designs advantageous and protectable per se, for which protection is claimed here. The subdivision of the application into individual sections and sub-headings does not limit the statements made thereunder in their general validity.

BRIEF DESCRIPTION OF THE DRAWINGS

Examples of the invention are shown schematically in the drawings and are explained in more detail in the following. The drawings show in.

DETAILED DESCRIPTION OF THE EXAMPLES

Figure 1:
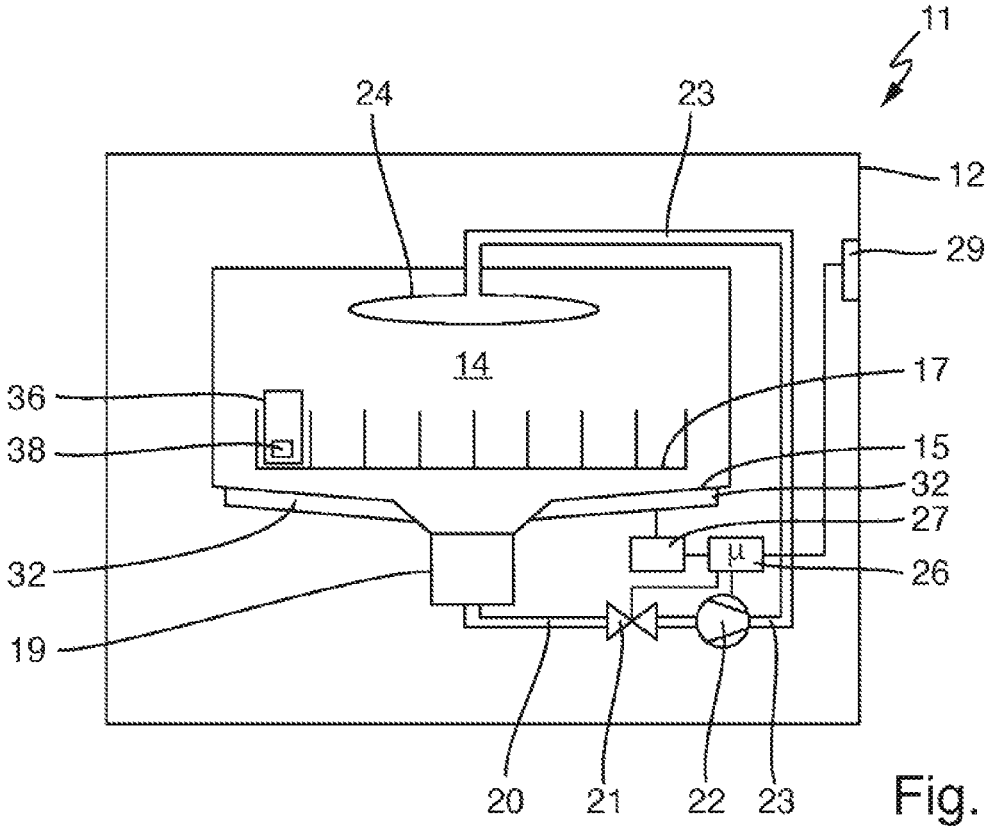
FIG. 1 a schematic and simplified representation of a design of a dishwasher in accordance with the invention, FIG. 2 the lower area of the dishwasher from FIG. 1 in a slightly enlarged representation, FIG. 3 a variation of the lower area of the dishwasher with an external operating device on a door, FIG. 4 an oblique representation of the view from FIG. 3, FIG. 5 a functional overview of the invention, showing how a transformer is connected to several functional units to permit signal transmission, FIG. 6 a plan view onto the transformer with rectangular single-winding transmitting coils and transmitting capacitors as L-C-resonant circuits and FIG. 7 a single L-C-resonant circuit with a single-winding transmitting coil and a transmitting capacitor.

FIG. 1 shows a dishwasher 11 in accordance with the invention in a housing 12 inside which a tub 14 is located. The tub 14 has side tub walls, an upper cover and a tub floor 15. Access is via a door, not shown here.

A rack 17 is arranged at the bottom of the tub 14, further racks may be arranged in particular above it. A downward outlet 19 is provided on the tub floor 15, possibly draining from a so-called sump of the tub 14. A filter device known per se is advantageously provided in the outlet 19. A pump line 20 leads from the outlet 19 to a pump 22 by means of a pump valve 21. By means of the pump valve 21, a water flow can be controlled, of course also using the operation of the pump 22. A supply line 23 runs in turn from the pump 22 away to the side and then upwards to a spray arm 24 arranged at the top of the tub 14 in known manner. A further spray arm may also be provided in accordance with FIG. 2 at the bottom of the tub 14, as is known per se from the prior art.

The dishwasher 11 has a control unit 26 which is connected to an electronic power unit 27 or which controls the latter. The control unit 26 is advantageously in control of the entire dishwasher 11 and hence is the only control unit, in particular with a single microcontroller. The control unit 26 is thus provided for an integrated operating device, not shown here, of the dishwasher 11, but also to control the pump 22 and the pump valve 21 and any further valves, not shown here, which are of course present. The control unit 26 however does not control the pump 22, at least not a pump motor, directly, but via an electronic power unit 27, advantageously an inverter. In an advantageous embodiment of the invention, the pump 22 can also have an associated heating unit, particularly advantageously integrated therein. This heating unit too can then be advantageously precisely controlled via the control unit 26 and the electronic power unit 27. Sensors, in particular temperature sensors, arranged in the pump 22, in particular on said heating unit, are also evaluated using the control unit 26.

The control unit 26 is also connected to a communication device 29, shown in FIG. 1 top right on the housing 12. This communication device 29 can be an interface to the outside, for example for servicing the dishwasher 11, alternatively also for mobile external operating devices, for example mobile terminals, that can be wirelessly connected and using which the dishwasher 11 can be controlled or at least its operation monitored. The communication device 29 could therefore be designed for example as a USB port, advantageously for wireless communication, for example by means of NFC, Bluetooth or the like.

A transformer 32 is arranged as a transmission device in accordance with the invention and as described above on the tub floor 15, in particular arranged on its underside so that no tightness problems can occur. Such a transmission device is known from DE 10 2017 201 109 A1, previously mentioned, to which explicit reference is made concerning details of its structure and design. The transformer 32 can in one embodiment of the invention extend substantially directly from a place near the control unit 26 or above the latter to an area underneath a dosing module 36. The arrangement of the dosing module 36 is then however restricted to a point above this strip-like transformer 32. Alternatively and advantageously, the transformer 32 takes up an area substantially corresponding to the tub floor 15, of course with a cutout around the outlet 19. The dosing module 36 can then be placed wherever required. Furthermore, other additional sensors, additional actuators or additional devices too can be connected thereto, with signal transmission possible and if required also power transmission, and hence be controlled and/or evaluated by the control unit 26, as explained in more detail in the following. As can be seen from the enlargement in FIG. 3, the dosing module 36 has in its lower region a module coil 38 designed for connection to the transformer 32 and hence corresponding to the aforementioned communication module. Reference is made in this connection to the above description as well as to the aforementioned DE 10 2017 201 109 A1. The dosing module 36 itself is advantageously designed as known from WO 2020/152004 A1. An integrated control unit of the dosing module 36 described there can be designed considerably more simply with the invention. Above all, a power source of the dosing module 36 is superfluous, since power can be supplied/transmitted by means of the transformer 32. The transformer 32 is also controlled with the electronic power unit 27 via the control unit 26. Since the transformer 32 in fact consists of a plurality of resonant circuits 35, as shown by the following figures in detail and as described in that connection, the electronic power unit 27 or the appropriate inverter takes on this function. A power requirement of the dosing module 36 and its valves, sensors or the like contained therein is as a rule not very great and hence can be supplied without any problem via the electronic power unit 27. The dosing of, for example, additives contained in the dosing module 36, such as detergents, rinsing agents, softeners or the like, can be very precisely controlled by the control unit 26. The control unit 26 can also access information from sensors or the like contained in the dosing module 36.

Figure 2:
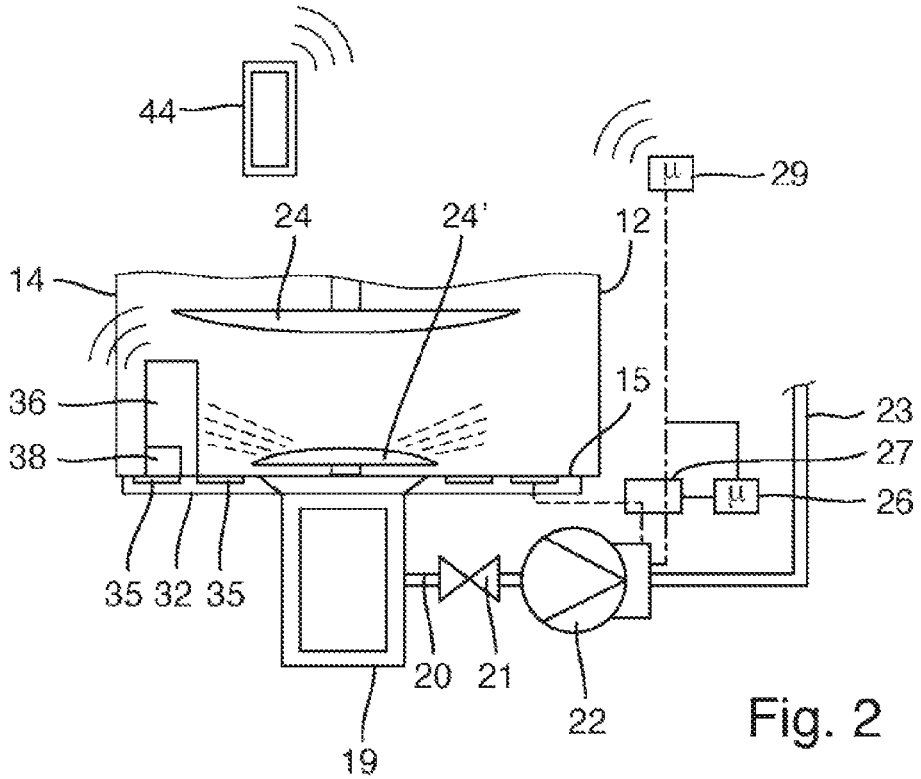
Figure 3:
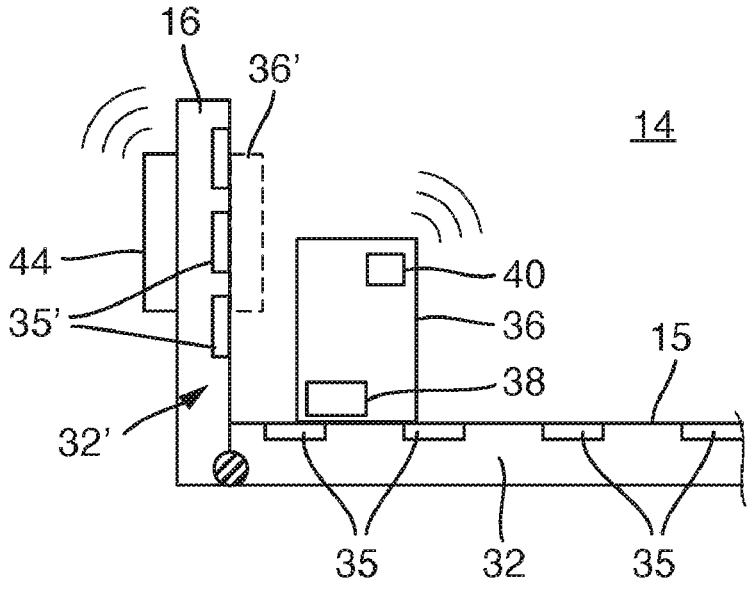

The slightly enlarged representation of a section through the dishwasher 11 according to FIG. 2 shows a lower spray arm 24' in the tub 14, the rack being omitted for the sake of clarity. Furthermore, it is shown that the control unit 26 is connected to a communication device 29 designed for radio contact. Also shown here is an external operating device 44, as mentioned above. This can either connect by radio to the communication device 29, such that the dishwasher 11 can be controlled therewith; alternatively, the external operating device 44 can also, as shown in FIG. 3, be fastened directly to the dishwasher 11. A signal transmission can then be varied, and a communication device 29 is no longer needed or in any event is not used. Instead the external operating device 44 can be attached to a door 16 of the dishwasher 11, for example in easily detachable manner. The transformer 32 is routed from the tub floor 15 practically around the corner and upwards along the door 16 as transformer 32', i.e. continuously, or possibly connected to a further transformer of this type. The transformer 32' in the door 16 has resonant circuits 35' and is thus similar in structure to the transformer 32 on the tub floor 15. Since transformers of this type can however transmit signals and power in the sideways or lateral direction anyway, such transmission also goes around the corner or from the tub floor 15 into the door 16.

The external operating device 44 is also supplied with power via the transformer 32, for example to operate lights and/or a display used as an indicator. Inputs by an operator at the external operating device 44 are transmitted by means of the transformers 32' and 32 to the control unit 26 to be processed there.

Figure 4:
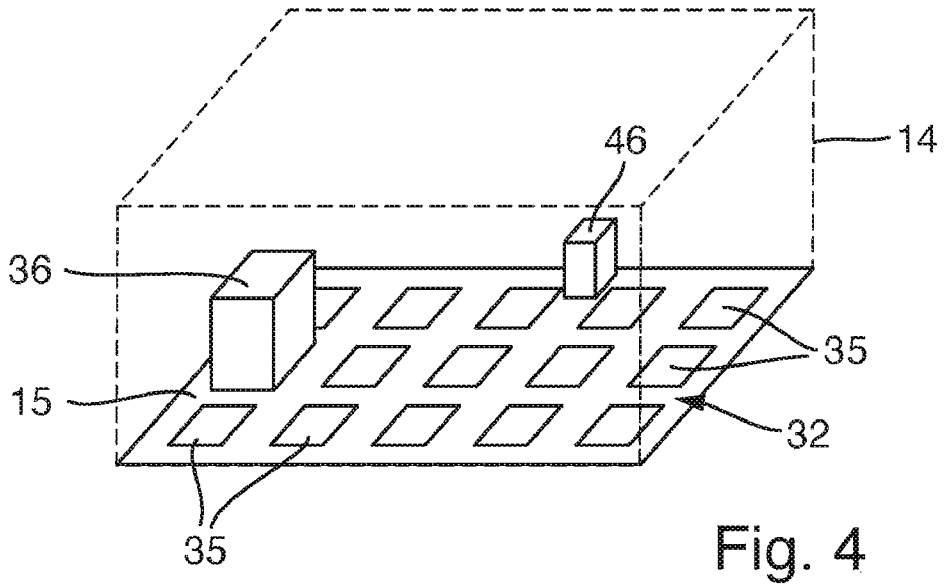

As indicated in FIGS. 2 to 4 in sketch form, the transformer 32 has a plurality of resonant circuits 35 in the surface in two directions. These are, in accordance with the prior art as per DE 10 2017 201 109 A1, arranged close to one another, with this not being explained again in detail.

The dosing module 36 can also have a module transmitter 40 for transmitting radio signals for example to outside the dishwasher 11, in particular either also to the external operating device 44 arranged there or to a diagnostics unit or the like. Advantageously, the dosing module 36 has however no module transmitter 40 of its own, as both expense can be spared and any communication with the control unit 26 can be via the transformer 32. The control unit 26 in turn can have the previously described communication device 29 to the outside, which is then for example is arranged outside the tub 14. This usually consists of stainless steel and thus is often an obstacle to radio transmission of signals passing through it.

In FIG. 4 it can be discerned from the perspective illustration how the transformer 32 is designed spatial or planar and in particular largely covers the tub floor 15 of the tub 14. The previously explained dosing module 36 is shown in the left-hand region. A self-sufficient additional sensor 46 is arranged in the rear region, and can detect certain sensor values inside the tub 14. These can go beyond the purpose for which the dosing module 36 was designed. It is for example possible to subsequently purchase appropriate self-sufficient additional sensors as relatively inexpensive functional units. The expensively designed dosing module 36 then no longer needs to be replaced. It is readily discernible from FIG. 4 that the dosing module 36 per se can be arranged as required in the tub 14 on the tub floor 15 or in a rack 17 extending just above it, in accordance with FIG. 1. It is always connected to the control unit 26 and to the electronic power unit 27 by means of the transformer 32.

The control unit 26 and the electronic power unit 27 can be designed such that there is a control mode and a pump mode. In the control mode, the transformer 32 is controlled, and so all functional units connected thereto are controlled and evaluated. In a pump mode, the transformer 32 is advantageously disconnected from the electronic power unit 27, and the latter operates only a drive motor and/or a heating unit of the pump 22. The electronic power unit 27 can then be kept simpler in its design.

Figure 5:
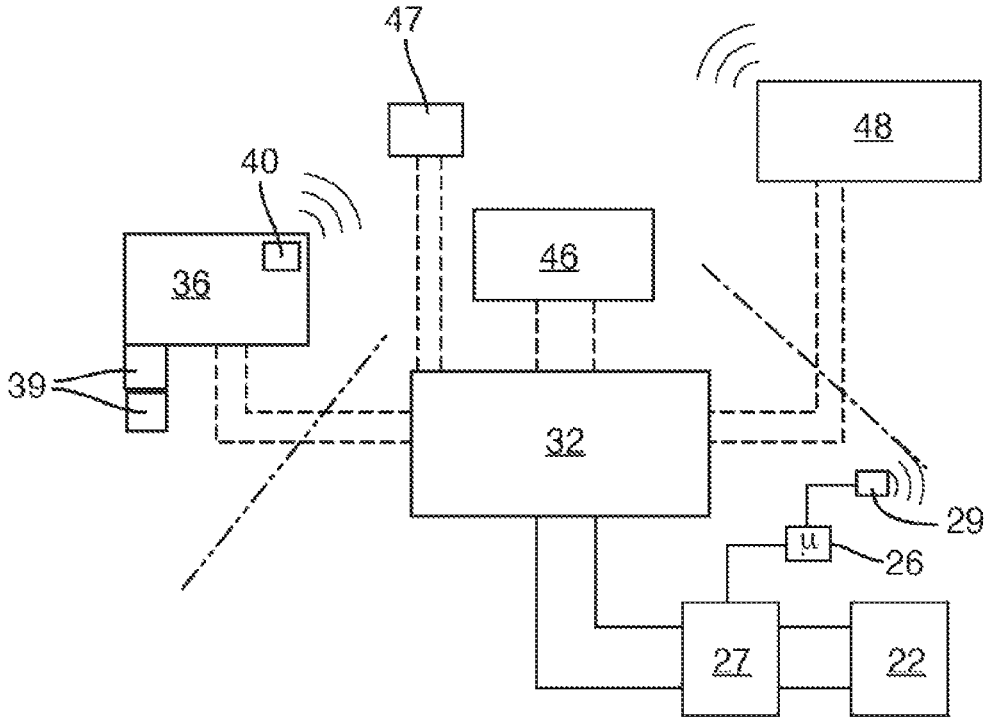

The schematic general drawing in FIG. 5 shows how the transformer 32 represents, in a manner of speaking, a kind of communication network. The dosing module 36 is connected to the transformer 32 and hence to the control unit 26 as indicated by dashed lines. This also applies for dosing sensors 39 and for a module transmitter 40 that are part of the dosing module 36.

A further dashed-line connection can be formed to self-sufficient additional sensors 46 or to self-sufficient additional actuators 47. Such self-sufficient unit actuators can also permit dosing of certain agents for which the dosing module 36 might not be designed.

A further dashed-line connection extends from the transformer 32 to a self-sufficient additional unit 48. This can for example be, according to the example in FIG. 3, an external operating device and in general a mobile terminal.

The transformer 32 is directly connected to the electronic power unit 27 that controls it and hence receives its signals, which are passed on to the control unit 26. Furthermore, the pump 22 too is connected to the electronic power unit 27. The latter is in turn connected to the control unit 26, to which a previously described communication device 29 is connected.

Thanks to the signal-transmitting connection, using which power can also be distributed to the tub floor 15 of the dishwasher 11, a corresponding functionality in the dosing module 36 can be dispensed with. It can therefore be of simpler design and above all easier and simpler to operate. Furthermore, further functional units such as the aforementioned additional sensors, additional actuators or additional devices in the dishwasher 11 can be subsequently inserted, although the dishwasher 11 was not even originally designed for this.

As previously explained, the control unit 26 can detect, based on the information from the transformer 32, where in the region of the latter or where on the tub floor 15 the dosing module 36 or one of the aforementioned additional units is arranged. A control unit can then take into account this attachment place in particular, which makes the control and hence also the functioning of the dosing module particularly precise and versatile as well as adaptable.

Figure 6:
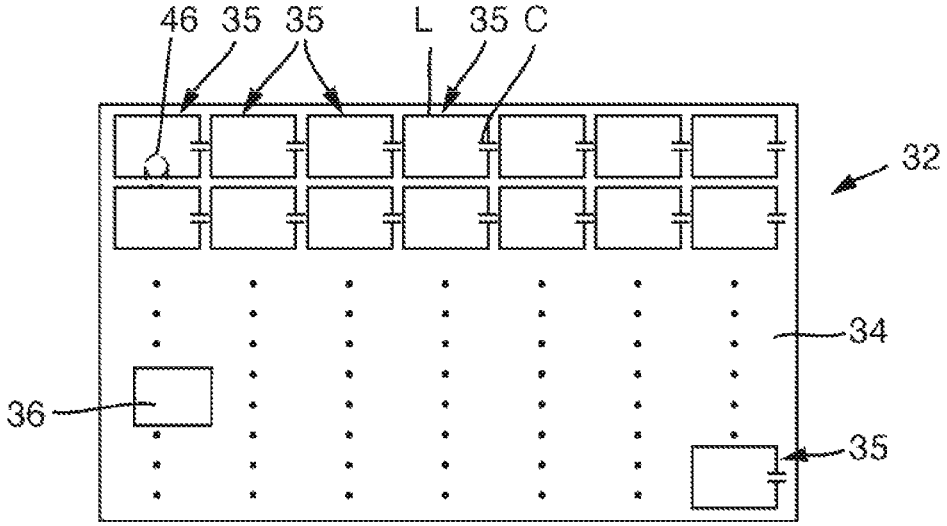

A transformer 32 is shown in FIG. 6 in a plan view. It is, as the sectional view of FIG. 2 already shows, very flat and has for example a thin carrier 34, which can even be designed film-like. The L-C-resonant circuits 35 can be directly attached to this carrier 34, even as a film, either by affixing or by direct coating or printing. The person skilled in the art is familiar with corresponding methods and is not presented with any problems. It can be discerned that the L-C-resonant circuits 35 each have a transmitting coil L and a transmitting capacitor C. In the representation in FIG. 6, the carrier 34 should be provided largely over its full surface, in particular except for a central leadthrough for the outlet 19, with L-C-resonant circuits 35 of this type.

Advantageously, all L-C-resonant circuits 35 are designed identical. As can be discerned, they are also aligned or arranged in the same way. This is not essential, but has proved advantageous for good power transmission inside the transformer.

The distance between adjacent L-C-resonant circuits 35 and above all the transmitting coils L can be relatively short and for example be between 1 mm and 15 mm, advantageously between 2 mm and 10 mm. This applies for transmitting coils L arranged both laterally adjacent to one another and arranged one behind the other. The distance should be so short that they are in any case inductively coupled to one another in every direction. In an embodiment of the invention, it is even conceivable for different transmitting coils L, in particular adjacent ones, to extend in different planes and even overlap in the plan view.

Figure 7:
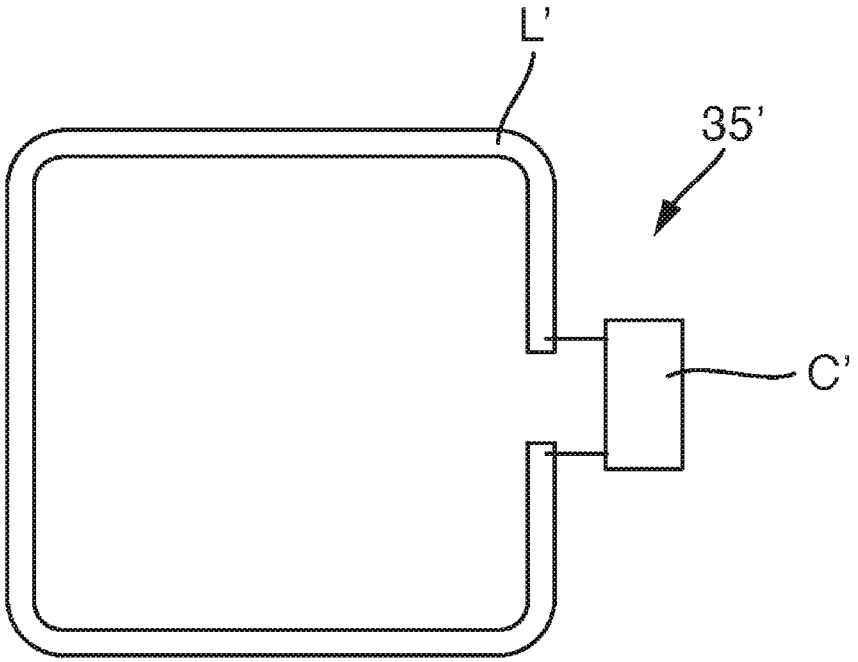

FIG. 7 shows in an enlargement an L-C-resonant circuit 35' as it might be designed in actual practice. It has a transmitting coil L' that consists of a single winding and whose coil ends are not completely closed or have a short distance from one another. A transmitting capacitor C' is connected to these coil ends, wherein this transmitting capacitor is a discrete component, for example an SMD component. The capacitance can be in the region of <1 mF, advantageously <100 μF.

An inductance of a single-winding transmitting coil L' can be in the region of around 1 μH. A capacitance of the transmitting capacitor C' can be, for a desired frequency of around 20 kHz, slightly above 30 μF, and for a frequency of 30 kHz around 15 μF. The transmitting capacitors C' must be selected accordingly.

An increase in the number of windings of a transmitting coil L has a significant effect on its inductance, as can easily be predicted. With each additional winding, of course, the expense of manufacturing the transmitting coils L and hence also the entire transformer 32 rises.

However, the expense of manufacturing additional windings can be worthwhile, if in particular very different frequencies in the system or in the dishwasher are to be harmonized, for example the frequency of the inverter with the frequency of the transmission, by means of NFC, Bluetooth, or the like. The options for harmonization are known to the person skilled in the art from the theory of coupled resonant circuits. It is only necessary to harmonize the L-C resonances and the couplings to one another, as is however described in detail in the literature on coupled resonant circuits. Furthermore, it can generally be of advantage to focus internally in the dishwasher on frequencies in the higher kHz range, advantageously frequencies of 30 kHz or 50 kHz up to frequencies of 80 kHz or 200 kHz. This can ensure that no disturbances of the electromagnetic field from the outside negatively affect communication between for example the transmission device and the dosing module.

The invention claimed is:

1. Dishwasher having:

a tub with tub walls and with an outlet, water pipes, valves and a pump, at least one water inlet into said tub connected to said pump by means of said water pipes, a dosing module in said tub containing additives and/or cleaning agents for adding to a cleaning process, wherein said dosing module has at least one supply compartment for an additive and/or a cleaning agent and has a dosing valve for release into said tub, wherein said dosing module is designed as a self-contained structural unit being independent of said dishwasher and is removable from said dishwasher, a control unit for said dishwasher, for said dosing module, for said pump and for said valves, wherein:

said dosing module has a communication module for communicating with said control unit, a planar transmission device is arranged in a surface of said transmission device along a wall of said tub for transmission of signals and/or power, said transmission device has a plurality of resonant circuits inductively coupled to one another and each said resonant circuit having a transmitting coil and a transmitting capacitor as an L-C resonant circuit, wherein said transmitting coils extend substantially within said surface of said transmission device, said transmission device is arranged up to said communication module or up to a distance of less than 5 cm from said communication module and is connected to said communication module to permit signal transmission, said transmission device is connected to said control unit to permit said signal transmission.

2. Dishwasher according to claim 1, wherein a signal-transmitting connection between said communication module of said dosing module and said transmission device is designed wireless, namely inductively, wherein said communication module has for said purpose a coil being inductively couplable to said transmission device.

3. Dishwasher according to claim 1, wherein said dosing module has its own power source, said power source being a primary or secondary battery.

4. Dishwasher according to claim 1, wherein a wireless power supply of said dosing module is provided by means of said transmission device.

5. Dishwasher according to claim 1, wherein said control unit is connected directly or galvanically to said transmission device to permit said signal transmission.

6. Dishwasher according to claim 1, wherein said control unit is connected wirelessly and inductively to said transmission device to permit said signal transmission via a control coil, said control coil being inductively coupled to said transmission device.

7. Dishwasher according to claim 6, wherein said control unit is connected to an inverter, said converter being connected to said control coil, wherein said control unit controls said control coil via said inverter in a control mode for said signal transmission by means of said transmission device at said communication module of said dosing module.

8. Dishwasher according to claim 7, wherein said inverter is designed to operate said pump in a pump mode based on control signals of said control unit and to supply said pump with power.

9. Dishwasher according to claim 7, wherein said inverter, via said control coil and said transmission device, supplies said dosing module with power and controls said dosing module with control signals via its communication module.

10. Dishwasher according to claim 1, wherein said control unit is designed to control said valves in said dishwasher.

11. Dishwasher according to claim 1, wherein said control unit is the only control unit in said entire dishwasher.

12. Dishwasher according to claim 11, wherein said control unit has a microcontroller which is the only microcontroller in said entire dishwasher.

13. Dishwasher according to claim 1, wherein a signal-transmitting connection to said control unit from outside said dishwasher is provided by means of a mobile terminal such as a tablet computer or a smartphone.

14. Dishwasher according to claim 13, wherein said transmission device is also provided on said inner face of an outside of said dishwasher in order to provide an inductive coupling to said mobile terminal there for signal transmission to said control unit or to said dosing module.

15. Dishwasher according to claim 14, wherein said transmission device is also provided on a door of said dishwasher.

16. Dishwasher according to claim 1, wherein said transmission device takes up at least one third of a floor surface of said tub as a tub wall.

17. Dishwasher according to claim 16, wherein said transmission device takes up at least two thirds of said floor surface.

18. Dishwasher according to claim 1, wherein said transmission device and said control unit are designed to detect a location at which said dosing module is arranged in said tub.

19. Dishwasher according to claim 18, wherein said at least one water outlet is controllable by said control unit such that water is conveyed substantially or exclusively to a location at which said dosing module is arranged.

20. Dishwasher according to claim 19, wherein said at least one water outlet is a nozzle adjustable in its direction or has a nozzle adjustable in its direction.

21. Method for controlling a dishwasher according to claim 1, wherein said control unit controls said dosing module by means of its communication module via said transmission device in order to release a certain additive and/or cleaning agent.

22. Computer program designed to perform the method according to claim 21 at said control unit of said dishwasher having:

a tub with tub walls and with an outlet, water pipes, valves and a pump, at least one water inlet into said tub connected to said pump by means of said water pipes, a dosing module in said tub containing additives and/or cleaning agents for adding to a cleaning process, wherein said dosing module has at least one supply compartment for an additive and/or a cleaning agent and has a dosing valve for release into said tub, wherein said dosing module is designed as a self-contained structural unit being independent of said dishwasher and is removable from said dishwasher, a control unit for said dishwasher, for said dosing module, for said pump and for said valves, wherein:

said dosing module has a communication module for communicating with said control unit, a planar transmission device is arranged in a surface of said transmission device along a wall of said tub for transmission of signals and/or power, said transmission device has a plurality of resonant circuits inductively coupled to one another and each said resonant circuit having a transmitting coil and a transmitting capacitor as an L-C resonant circuit, wherein said transmitting coils extend substantially within said surface of said transmission device, said transmission device is arranged up to said communication module or up to a distance of less than 5 cm from said communication module and is connected to said communication module to permit signal transmission, said transmission device is connected to said control unit to permit said signal transmission.

23. Data carrier, on which a computer program according to claim 22 is stored.

* * * * *